US008617648B2

(12) United States Patent
Wu et al.

(10) Patent No.: US 8,617,648 B2
(45) Date of Patent: Dec. 31, 2013

(54) IMAGING MEMBERS AND METHOD OF TREATING AN IMAGING MEMBER

(75) Inventors: Jin Wu, Webster, NY (US); Liang-Bih Lin, Rochester, NY (US); Robert W. Hedrick, Spencerport, NY (US); Rachel Lee Brown, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 1831 days.

(21) Appl. No.: 11/345,157

(22) Filed: Feb. 1, 2006

(65) Prior Publication Data

US 2007/0178396 A1 Aug. 2, 2007

(51) Int. Cl.
*B05D 3/02* (2006.01)

(52) U.S. Cl.
USPC ..... 427/226

(58) Field of Classification Search
USPC ..... 427/213.35, 226
See application file for complete search history.

(56) References Cited

U.S. PATENT DOCUMENTS

| | | | | |
|---|---|---|---|---|
| 4,265,990 | A | 5/1981 | Stolka et al. | 430/58.8 |
| 4,419,427 | A | 12/1983 | Graser et al. | 430/58.6 |
| 4,429,029 | A | 1/1984 | Hoffmann et al. | 430/58.6 |
| 4,464,450 | A | 8/1984 | Teuscher | 430/58.8 |
| 4,501,906 | A | 2/1985 | Spietschka | 549/232 |
| 4,555,463 | A | 11/1985 | Hor | 430/57.3 |
| 4,587,189 | A | 5/1986 | Hor et al. | 430/58.8 |
| 4,666,806 | A * | 5/1987 | Pai et al. | 430/57.5 |
| 4,709,029 | A | 11/1987 | Spietschka | 544/125 |
| 4,714,666 | A | 12/1987 | Wiedemann et al. | 430/59.1 |
| 4,937,164 | A | 6/1990 | Duff et al. | 430/58.8 |
| 4,968,571 | A | 11/1990 | Gruenbaum et al. | 430/59.1 |
| 5,019,473 | A | 5/1991 | Nguyen et al. | 430/59.1 |
| 5,225,307 | A | 7/1993 | Hor et al. | 430/136 |
| 5,336,577 | A | 8/1994 | Spiewak et al. | 430/58.25 |
| 5,350,644 | A | 9/1994 | Graetzel et al. | 429/111 |
| 5,473,064 | A | 12/1995 | Mayo et al. | 540/141 |
| 5,645,965 | A | 7/1997 | Duff et al. | 430/58.8 |
| 5,756,245 | A | 5/1998 | Esteghamatian et al. | 430/58.8 |
| 6,051,351 | A | 4/2000 | Hsiao et al. | 430/59.1 |
| 6,074,791 | A * | 6/2000 | Jennings et al. | 430/58.8 |
| 6,194,110 | B1 | 2/2001 | Hsiao et al. | 430/58.7 |
| 6,399,154 | B1 * | 6/2002 | Williams et al. | 427/327 |
| 6,656,651 | B1 | 12/2003 | Bender et al. | 430/58.8 |

OTHER PUBLICATIONS

U.S. Appl. No. 11/240,446, filed Oct. 3, 2005, of John F. Graham et al., entitled "Method of Treating an Electrophotographic-Imaging Member With a Rare-Earth Metal" 22 pages, not yet published.

* cited by examiner

*Primary Examiner* — Robert Vetere
(74) *Attorney, Agent, or Firm* — Marylou J. Lavoie

(57) ABSTRACT

A method for treating a metal substrate or a metallized substrate of an imaging member including providing a metal or metallized substrate of an imaging member; treating the metal or metallized substrate with a sol-gel composition comprising a rare earth metal to form a passivation layer on the metal or metallized substrate using a sol-gel process.

10 Claims, No Drawings

IMAGING MEMBERS AND METHOD OF TREATING AN IMAGING MEMBER

BACKGROUND

The present disclosure is generally related to imaging members and more particularly related to photosensitive members and methods of treating the substrate of electrophotographic imaging members, which may be used as photoreceptors in various devices, such as copy machines. The methods reduce corrosion, fatigue, and printable defects on the substrate.

In the art of electrophotography, an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members are usually multilayered photoreceptors that comprise a substrate support, an electrically conductive layer, an optional hole blocking layer, an adhesive layer, a charge generating layer, and a charge transport layer in either a flexible belt form or a rigid drum configuration. Multilayered flexible photoreceptor belts may include an anti-curl layer on the backside of the substrate support, opposite to the side of the electrically active layers, to render the desired photoreceptor flatness. One type of multilayered photoreceptor comprises a layer of finely divided particles of a photoconductive inorganic compound dispersed in an electrically insulating organic resin binder. The charge generating layer is capable of photogenerating holes and injecting the photogenerated holes into the charge transport layer. Photoreceptors can also be single layer devices. For example, single layer organic photoreceptors typically comprise a photogenerating pigment, a thermoplastic binder, and hole and electron transport materials.

As more advanced, higher speed electrophotographic copiers, duplicators and printers were developed, the performance requirements for the xerographic components increased. Moreover, complex, highly sophisticated, duplicating and printing systems employing flexible photoreceptor belts, operating at very high speeds, have also placed stringent mechanical requirements and narrow operating limits as well on photoreceptors.

Ideally, a photoreceptor can be charged capacitively with no dark decay. However, typically during the charging step, charge depletion results in voltage potentials that are less than the ideal capacitive value. Charge depletion is the difference between the capacitive value and the actual potential on a photoreceptor.

The substrates of many modern photoconductive imaging members must be highly flexible, adhere well to flexible supporting layers, and exhibit predictable electrical characteristics within narrow operating limits to provide excellent toner images over many thousands of cycles.

After long-term use in an electrophotographic copying machine, multilayered photoreceptors may be observed to exhibit a dramatic dark development potential change between cycles. The print quality and intrinsic photoreceptor life are significantly affected by the electrochemical reactions at an aluminum substrate photoconductive layer interface. For example, oxidation of the aluminum substrate (or aluminum ground plane disposed on a supporting substrate) occurs as electric current is passed across the junction between the metal and photoreceptor, leading to degradation of image quality.

The oxides of aluminum which naturally form on the aluminum substrate act as an electrical blocking layer preventing charge injection during charging of the photoconductive device. If the resistivity of this aluminum oxide blocking layer becomes too great, a residual potential will build across the layer as the device is cycled. Since the thickness of the oxide layer on an aluminum substrate is not stable, the electrical performance characteristic of a composite photoreceptor undergoes changes during electrophotographic cycling. The accelerated oxidation of the metal substrate increases optical transmission, causes copy quality nonuniformity and can ultimately result in loss of electrical grounding capability. Further, aluminum films are relatively soft and exhibit poor scratch resistance during photoreceptor fabrication processing.

After long-term use in an electrophotographic copying machine, multilayered photoreceptors utilizing the aluminum ground plane may be observed to exhibit a dramatic dark development potential change between cycles.

One type of printable defect is small unexposed areas on a photoreceptor that fail to retain an electrostatic charge. These defects become visible to the naked eye after development with toner material. On copies prepared by depositing black toner material on white paper, these defects may be white or black depending upon whether a positive or reversal image development process is employed. In positive image development, these defects appear as white spots in the solid image areas of the final xerographic print. In other words, the image areas on the photoreceptor corresponding to the white spot fails to attract toner particles in positive write-reading image development. In reversal image development, black spots appear in background areas of the final xerographic copy. The white spots and black spots always appear in the same location of the final electrophotographic copies during cycling of the photoreceptor. The white spots and black spots do not exhibit any single characteristic shape, are small in size, and are visible to the naked eye.

Corrosion limits photoreceptor electrical life and causes print defects. Therefore, methods for controlling corrosion that do not negatively impact on retention of electrostatic charge or the mechanical integrity of the substrate are needed. The present methods for treating photoreceptive members and photoreceptive members disclosed herein answer that need.

Photoconductive or photoresponsive imaging members are disclosed in the following U.S. Patents and U.S. Patent Applications, the disclosures of each of which are totally incorporated by reference herein, U.S. Pat. Nos. 4,265,990, 4,419,427, 4,429,029, 4,501,906, 4,555,463, 4,587,189, 4,709,029, 4,714,666, 4,937,164, 4,968,571, 5,019,473, 5,225,307, 5,336,577, 5,473,064, 5,645,965, 5,756,245, 6,051,351, 6,074,791, 6,194,110, 6,656,651, and commonly assigned, co-pending U.S. patent application Ser. No. 11/240,446, filed Oct. 3, 2005, of John F. Graham, entitled "Method of Treating an Electrophotographic Imaging Member with a Rare-earth Metal." The appropriate components and process aspects of the each of the foregoing may be selected for the present disclosure in embodiments thereof.

SUMMARY

Embodiments disclosed herein include a method for treating a metal substrate or a metallized substrate of an imaging member comprising providing a metal or metallized substrate of an imaging member; treating the metal or metallized substrate with a sol-gel composition comprising a rare earth metal to form a passivation layer on the metal or metallized substrate using a sol-gel process.

Embodiments disclosed herein further include an imaging member comprising a metal or metallized substrate having a passivation layer prepared using a sol-gel process, wherein the passivation layer comprises a rare earth metal; and one or more additional layers disposed on the metal substrate, wherein the additional layer or layers comprise a charge generating component and a charge transport component.

In addition, embodiments disclosed herein include an image forming apparatus for forming images on a recording medium comprising a photoreceptor member having a charge retentive surface to receive an electrostatic latent image thereon, wherein said photoreceptor member comprises a metal or metallized substrate having a passivation layer prepared using a sol-gel process, wherein the passivation layer comprises a rare earth metal, a charge generating layer, and a charge transport layer comprising charge transport materials dispersed therein; a development component to apply a developer material to said charge-retentive surface to develop said electrostatic latent image to form a developed image on said charge-retentive surface; a transfer component for transferring said developed image from said charge-retentive surface to another member or a copy substrate; and a fusing member to fuse said developed image to said copy substrate.

DETAILED DESCRIPTION

Disclosed herein is a method for improving chemical stability in a metal or metallized substrate of an electrophotographic imaging member comprising providing a metal or metallized substrate of an imaging member; treating the metal or metallized substrate with a sol-gel composition comprising a rare earth metal to form a passivation layer on the metal or metallized substrate using a sol-gel process. The method, which may be considered a passivation method, in embodiments improves corrosion resistance on the substrate, inhibits the formation of printable defects, and extends photoreceptor life. Further disclosed is an imaging member comprising a metal or metallized substrate having a passivation layer prepared using a sol-gel process, wherein the passivation layer comprises a rare earth metal; and one or more additional layers disposed on the metal substrate, wherein the additional layer or layers comprise a charge generating component and a charge transport component. Also disclosed is an image forming apparatus for forming images on a recording medium comprising a photoreceptor member having a charge retentive surface to receive an electrostatic latent image thereon, wherein said photoreceptor member comprises a metal or metallized substrate having a passivation layer prepared using a sol-gel process, wherein the passivation layer comprises a rare earth metal, a charge-generating layer, and a charge transport layer comprising charge transport materials dispersed therein; a development component to apply a developer material to said charge-retentive surface to develop said electrostatic latent image to form a developed image on said charge-retentive surface; a transfer component for transferring said developed image from said charge-retentive surface to another member or a copy substrate; and a fusing member to fuse said developed image to said copy substrate.

The substrate may be a metal substrate or a metallized substrate. While a metal substrate is substantially or completely metal, the substrate of a metallized substrate is made of a different material that has at least one layer of metal applied to at least one surface of the substrate. The material of the substrate of the metallized substrate can be any material for which a metal layer is capable of being applied. For instance, the substrate can be a synthetic material, such as a polymer.

Any metal or metal alloy can be selected for the metal or metallized substrate. Typical metals employed for this purpose include aluminum, zirconium, niobium, tantalum, vanadium, hafnium, titanium, nickel, stainless steel, chromium, tungsten, molybdenum, and the like. Useful metal alloys may contain two or more metals such as zirconium, niobium, tantalum, vanadium and hafnium, titanium, nickel, stainless steel, chromium, tungsten, molybdenum, and the like. Aluminum, such as mirror-finish aluminum, is selected in embodiments for both the metal substrate and the metal in the metallized substrate. All types of substrates may be used, including honed substrates, rough lathed substrates, anodized substrates, boehmite-coated substrates and mirror substrates.

A metal substrate or metallized substrate can be selected. Examples of substrate layers selected for the present imaging members include opaque or substantially transparent materials, and may comprise any suitable material having the requisite mechanical properties. Thus, for example, the substrate can comprise a layer of insulating material including inorganic or organic polymeric materials, such as Mylar™, a commercially available polymer, Mylar™ containing titanium, a layer of an organic or inorganic material having a semiconductive surface layer, such as indium tin oxide or aluminum arranged thereon, or a conductive material such as aluminum, chromium, nickel, brass or the like. The substrate may be flexible, seamless, or rigid, and may have a number of different configurations. For example, the substrate may comprise a plate, a cylindrical drum, a scroll, an endless flexible belt, or other configuration. In some situations, it may be desirable to provide an anticurl layer to the back of the substrate, such as when the substrate is a flexible organic polymeric material, such as for example polycarbonate materials, for example Makrolon™ a commercially available material.

The method includes forming an oxide layer, which may be considered a passivation layer, on the metal or metallized substrate using a sol-gel process. In embodiments, the metal or metallized substrate contains an oxide layer and the oxide layer is treated with the sol-gel composition comprising a rare earth metal. The sol-gel process comprises generally, for example, preparation of the sol, gelation of the sol, and removal of the solvent. The preparation of a metal oxide sol is disclosed in, for example, B. O'Regan, J. Moser, M. Anderson and M. Gratzel, J. Phys. Chem., vol. 94, pp. 8720-8726 (1990), C. J. Barbe, F. Arendse, P. Comte, M. Jirousek, F. Lenzmann, V. Shklover and M. Gratzel, J. Am. Ceram. Soc., vol. 80(1), pp. 3157-3171 (1997), Sol-Gel Science, eds. C. J. Brinker and G. W. Scherer (Academic Press Inc., Toronto, 1990), 21-95, U.S. Pat. No. 5,350,644, the disclosure of which is totally incorporated by reference herein, M. Graetzel, M. I. Nazeeruddin and B. O'Regan, Sep. 27, 1994, P. Arnal, R. J. P. Corriu, D. Leclercq, P. H. Mutin and A. Vioux, Chem. Mater., vol. 9, pp. 694-698. Chemical additives can be reacted with a precursor such as titanium alkoxide to modify the hydrolysis-condensation reactions during sol preparation.

Such precursors have been disclosed, for example, in J. Livage, Mat. Res. Soc. Symp. Proc., vol. 73, pp. 717-724 (1990. Sol refers, for example, to a colloidal suspension, from about 1 to about 1,000 nanometers in diameter, solid particles in a liquid, see P. J. Flory, Faraday Disc., Chem. Society, 57, pages 7-18 (1974) for example, and gel refers, for example, to a continuous solid skeleton enclosing a continuous liquid phase, both phases being of colloidal dimensions or sizes. A gel can also be formed by covalent bonds by chain entanglement.

The method for treating the metal substrate using a sol-gel process includes preparation of the sol-gel coating solution comprising at least a rare earth metal to provide a rare earth metal oxide passivation layer. The rare earth metal is selected, for example, from the group consisting of yttrium, lanthanum, neodymium, praseodymium, cerium, and combinations thereof. In a selected embodiment, the rare earth metal comprises cerium, and said cerium originates from an organic cerium compound, for example, cerium (IV) t-butoxide, cerium (IV) isopropoxide, cerium (IV) ethylthioethoxide, cerium (IV) methoxyethoxide, and the like. In another selected embodiment, the rare earth metal comprises yttrium, and said yttrium originates from organic yttrium compounds, for example, yttrium isopropoxide, yttrium methoxyethoxide, aluminum yttrium alkoxides $[Al_3Y(OR)_x]$, barium yttrium alkoxides $[Ba_2Y(OR)_x]$, and the like. In another selected embodiment, the rare earth metal comprises lanthanum, and said lanthanum originates from organic lanthanum compounds, for example, lanthanum isopropoxide, lanthanum methoxyethoxide, and the like. In another selected embodiment, the rare earth metal comprises neodymium, and said neodymium originates from organic neodymium compounds, for example, neodymium methoxyethoxide, and the like. In another selected embodiment, the rare earth metal comprises praseodymium, and said praseodymium originates from organic praseodymium compounds, for example, praseodymium methoxyethoxide, and the like.

In an alternate embodiment, the coating solution comprises a rare earth metal and at least one additional component, for example, at least one additional component selected from the group consisting of titanium, zirconium, aluminum, tin, antimony, germanium, zinc, indium, silicon, boron, yttrium, lanthanum, neodymium, praseodymium, cerium, barium, calcium, chromium, copper, iron, tantalum, tungsten, vanadium, niobium and the like. Said components originate from their organic compound precursors, for example, titanium (IV) isopropoxide, titanium n-propoxide, titanium ethoxide, titanium isobutoxide, titanium methoxide, poly(dibutyltitanate) $[(C_4H_9O)_2TiO]_{4-10}$, poly(octyleneglycoltitanate), diethoxysiloxane-ethyltitanate copolymer, zirconium n-butoxide, zirconium ethoxide, zirconium isopropoxide, zirconium n-propoxide, zirconium 2-ethylhexoxide, zirconium 2-methyl-2-butoxide, aluminum zirconium alkoxides $[Al_2Zr(OR)_x]$, barium zirconium alkoxides $[BaZr(OR)_x]$, aluminum n-butoxide, aluminum t-butoxide, aluminum ethoxide, aluminum propoxide, aluminum, isopropoxide, aluminum ethoxyethoxyethoxide, aluminum magnesium isopropoxide, di-s-butoxyaluminoxytriethoxysilane, aluminum copper alkoxides $[Al_2Cu(OR)_x]$, aluminum titanium alkoxides $[Al_2Ti(OR)_x]$, aluminum yttrium alkoxides $[Al_3Y(OR)_x]$, poly(oxoaluminum 2-ethylhexanoate), diethoxysiloxane-s-butylaluminate copolymer, tin (II) ethoxide, tin (IV) t-butoxide, bis(tri-n-butyl tin)oxide, antimony (III) n-butoxide, antimony (III) ethoxide, tris(trimethylsiloxy)antimony, poly (antimony ethylene glycoxide), tetra-n-butoxygermane, tetraethoxygermane, tetrakis(trimethylsiloxy)germane, zinc N,N-dimethylaminoethoxide, zinc methoxyethoxide, indium methoxyethoxide, tetra-isopropoxysilane, silicon tetraethoxide, boron n-butoxide, boron isopropoxide, boron trimethylsiloxide, barium isopropoxide, calcium ethoxide, chromium III isopropoxide, copper II ethoxide, iron III ethoxide, lanthanum isopropoxide, niobium V n-butoxide, niobium V ethoxide, praseodymium oxide, tantalum V ethoxide, tantalum V n-butoxide, tantalum V methoxide, tungsten V ethoxide, vanadium triisopropoxide oxide, vanadium tri-n-propoxide oxide, yttrium isopropoxide, and combinations thereof.

Thus, in selected embodiments, the final metal oxide layer is a mixed oxide layer of a cerium oxide with, for example, silicon oxide, titanium oxide, zirconium oxide, aluminum oxide, yttrium oxide, etc.

The sol-gel coating solution comprises solvents such as, but not limited to, isopropanol, methoxyethanol, n-propanol, methanol, ethanol, n-butanol, s-butanol, toluene, mineral spirits, heptane, tetrahydrofuran, water, hexane, methoxydiethyleneglycol, ethoxydiethyleneglycol, isopropyl-2-ethylhexanoate, and the like and mixtures thereof.

Generally, the process of preparation of the sol comprises modification of the precursor, such as cerium (IV) isopropoxide, with, for example, hydrolysis, and condensation. The hydrolysis can be accomplished for example by adding a mixture of the organic cerium compound and additional component or components to a flask, and adding an alcohol such as isopropanol from an addition funnel drop wise to the flask. Nitric acid is then added and stirring continued. After addition of nitric acid, the mixture is refluxed for a period of time at a temperature of for example from about 40° C. to about 120° C. or about 50° C. to about 80° C. while stirring. The contents of the flask can be concentrated by removing the solvent for example by using a rotary evaporator. The sol can be dispersed in a solvent, for example by sonification, and concentrated, for example by rotary evaporation.

Thereafter, the sol-gel coating solution comprising for example, solvents, organic metal compounds, and stabilizers, can be applied to the metal or metallized substrate using any suitable method as known to those skilled in the art, such as, for example, spin coating, coating with wire-wound rods, gravure, doctor blade, solution coating onto a web using a die, spray or dip coating, and roller coating. The sol-gel solution of rare earth metal alkoxide in a solvent is applied to the substrate and dried so that hydrolysis, condensation, and drying are accomplished in situ (that is, on the substrate) to provide a rare earth metal oxide, for example, cerium oxide, or a mixed rare earth metal oxide/additional component layer, for example a cerium oxide/additional component layer, for example, a cerium oxide/zirconium oxide, cerium oxide/titanium oxide, cerium oxide/silicon oxide, cerium oxide/yttrium oxide layer. For example, the coated substrate is subjected to thermal cure at a relatively low temperature, such as a temperature of less than about 300° C., a temperature of about 40° C. to about 300° C., a temperature of about 80° C. to about 200° C., or about 100° C. to about 160° C. is selected.

The sol-gel composition comprises in embodiments from about 1 to about 40 or about 5 to about 20 percent by weight ratio of rare earth metal oxide to solvent, wherein a total of the solution is about 100 percent.

The dried passivation layer comprises in embodiments from about 1 to about 100 or about 5 to about 30 percent by weight rare earth metal oxide and about 0 to about 99 or about 70 to about 95 percent by weight additional component oxides. Generally, the passivation layer comprises a very thin layer, such as, for example, a layer having a thickness of about 0.001 to about 2 micrometers, or about 0.01 to about 0.5 micrometers.

Also disclosed herein are electrophotographic imaging members comprising a metal or metallized substrate having a passivation layer prepared using a sol-gel process, wherein the passivation layer comprises a rare earth metal; and one or more additional layers disposed on the metal substrate, wherein the additional layer or layers comprise a charge generating component and a charge transport component.

The additional layers containing the charge transport component and the charge generating component may be applied as a single layer or may be applied separately as two distinct layers. The decision of whether to apply the components as a single layer or separate layers lies within the preference of the skilled artisan. Traditionally, the components are applied as separate layers; however, applying the components as a single layer may prove more convenient, cheaper, and may result in an electrophotographic-imaging member that is thinner or contains other desirable properties. The additional layers, whether as a single layer or separate layers, may be applied by techniques known to those in the art, such as chemical vaporization, sputtering, spraying, dipping, and spin-and-roller coating.

The thickness of the device typically ranges from about 2 μm to about 100 μm, from about 5 μm to about 50 μm, or from about 10 μm to about 30 μm. The thickness of each layer will depend on how many components are contained in that layer, how much of each component is desired in the layer, and other factors familiar to those in the art. If the charge generating component and charge transport component are applied in separate layers, the ratio of the thickness of the layer containing the charge-transport component to the layer containing the charge-generating component typically ranges from about 2:1 to about 400:1, or from about 2:1 to about 200:1.

The charge transport component transports charge from the charge generating layer to the surface of the photoreceptor. Often, the charge transport component is made up of several materials, including electrically active organic-resin materials such as polymeric arylamine compounds, polysilylenes (such as poly(methylphenyl silylene), poly(methylphenyl silylene-co-dimethyl silylene), poly(cyclohexylmethyl silylene), and poly(cyanoethylmethyl silylene)), and polyvinyl pyrenes. The charge-transport component typically contains at least one compound having an arylamine, enamine, or hydrazone group. The arylamine group may be represented in a compound having the formula:

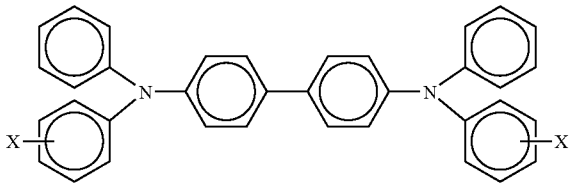

where X is an alkyl such as alkyl having from about 1 to about 20 carbons or from about 1 to about carbons, such as methyl, ethyl, propyl, butyl, and the like, or a halogen such as for example fluorine, bromine, chlorine, and iodine. The compound containing the arylamine may be dispersed in a resinous binder, such as a polycarbonate or a polystyrene. A selected compound having an arylamine group is N,N'-diphenyl-N,N-bis(3-methyl phenyl)-1,1'-biphenyl-4,4'-diamine.

The charge generating component converts light input into electron hole pairs. Examples of compounds suitable for use as the charge-generating component include vanadyl phthalocyanine, metal phthalocyanines (such as titanyl phthalocyanine, chlorogallium phthalocyanine, hydroxygallium phthalocyanine, and alkoxygallium phthalocyanine), metal-free phthalocyanines, benzimidazole perylene, amorphous selenium, trigonal selenium, selenium alloys (such as selenium-tellurium, selenium-tellurium arsenic, selenium arsenide), chlorogallium phthalocyanin, and mixtures thereof.

The additional layer or layers containing the charge transport and charge generating components can include various other materials, such as binder polymeric resin materials, film-including particles, or resin layers having a photoconductive material. If the charge transport component and charge generating component are applied in separate layers, the layer containing the charge generating component will typically contain the resinous binder composition. Suitable polymeric film-forming binder materials include, but are not limited to, thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins phenylene oxide resins, terephthalic acid resins, phenoxy resins, epoxy resins, phenolic resins, polystyrene and acrylonitrile copolymers, polyvinyl chloride, vinylchloride and vinyl acetate copolymers, acrylate copolymers, alkyd resins, cellulosic film formers, poly(amideimide), styrene-butadiene copolymers, vinylidinechloride-vinylchloride copolymers, vinylacetate-vinylidenechloride copolymers, vinylacetate-vinylidenechloride copolymers, styrene-alkyd resins, polyvinylcarbazole, and mixtures thereof.

The charge generating component may also contain a photogenerating composition or pigment. The photogenerating composition or pigment may be present in the resinous binder composition in various amounts, ranging from about 5% by volume to about 90% by volume (the photogenerating pigment is dispersed in about 10% by volume to about 95% by volume of the resinous binder); or from about 20% by volume to about 30% by volume (the photogenerating pigment is dispersed in about 70% by volume to about 80% by volume of the resinous binder composition). In one embodiment, about 8 percent by volume of the photogenerating pigment is dispersed in about 92 percent by volume of the resinous binder composition. When the photogenerating component contains photoconductive compositions and/or pigments in the resinous binder material, the thickness of the layer typically ranges from about 0.1 μm to about 5.0 μm, or from about 0.3 μm to about 3 μm. The photogenerating layer thickness is often related to binder content, for example, higher binder content compositions typically require thicker layers for photogeneration. Thicknesses outside these ranges may also be selected.

The electrophotographic-imaging member may further contain an undercoat layer between the metal or metallized substrate and the additional layers, and/or an overcoat layer on top of the additional layers. Thus the undercoat and overcoat layers are applied below and on top of the additional layers. For example, in embodiments, an undercoat layer is disposed between the passivation layer and the additional layer or layers. In embodiments, the imaging member is free of an undercoat layer.

The overcoat layer may be applied on top of the additional layers to protect the charge transport component and increase resistance to abrasion. Suitable overcoat layers include silicon-containing resins and cross-linked material having a skeleton having organic groups having charge-transporting properties. In such a composition, the silicon atom may be bound to the same or different carbon atom in the organic group, and the oxygen atom may be bonded to the silicon atom. The thickness of the overcoat layer typically ranges from about 2 μm to about 10 μm, or from about 3 μm to about 7 μm.

The undercoat layer, if introduced, is applied below the additional layers and above the substrate. In embodiments, an undercoat layer is disposed on the passivation layer. The undercoat is typically responsible for blocking holes or charge from injecting into the device from the substrate. The undercoat layer may contain an electron-blocking component and/or electron-transporting substance. Examples of the material that may be used for the undercoating layer include an organic zirconium compound (such as a zirconium chelate compound, a zirconium alkoxide compound, or a zirconium coupling agent), an organic titanium compound (such as a titanium chelate compound, a titanium alkoxide compound, or a titanate coupling agent), an organic aluminum compound (such as an aluminum chelate compound or an aluminum coupling agent), and an organic metallic compound (such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound or an aluminum zirconium alkoxide compound). A silane coupling agent may also be contained in the undercoating layer, examples of which include vinyltrichlorosilane, vinyltrimethoxysilane, vinyltriethoxysilane, vinyl-tris-2-methoxy ethoxysilane, vinyltriacetoxysilane, γ-glycidoxypropyltrimethoxysilane, γ-methacryloxypropyl trimethoxysilane, γ-aminopropyltrimethoxysilane, γ-chloropropyltrimethoxysilane, γ-2-amino ethylpropyltrimethoxysilane, γ-mercaptopropyltrimethoxysilane, γ-ureidopropyltriethoxysilane and β-3,4-epoxycyclohexyltrimethoxysilane. Furthermore, a binder resin may also be used in the undercoating layer, examples of which include polyvinyl alcohol, polyvinyl methyl ether, poly-N-vinylimidazole, polyethylene oxide, ethylcellulose, methylcellulose, an ethylene-acrylic acid copolymer, polyamide, polyimide, casein, gelatin, polyethylene, polyester, a phenol resin, a vinyl chloride-vinyl acetate copolymer, an epoxy resin, polyvinylpyrrolidone, polyvinylpyridine, polyurethane, polyglutamic acid, and polyacrylic acid.

In a selected embodiment, the undercoat layer comprises a titanium dioxide, for example a titanium dioxide in a phenolic resin/melanine resin.

As known by those of skill in the art, if positive charging is used, an electron-blocking layer is typically also used; if negative charging is used, a hole-blocking layer is typically also used. Charge blocking refers to both electron blocking and hole blocking. Some of the materials that form the undercoat layer can function as both an adhesive layer and a charge-blocking layer. Typical charge-blocking layers include crosslinked polymer resin containing a dispersion of $TiO_2$ (titania) and $SiO_2$ (silica), polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge-blocking layers may have a dry thickness between about 0.002 μm (20 Angstroms) and about 20 μm. Silanes and silane reaction products such as those described in U.S. Pat. No. 4,464,450, the disclosure of which is totally incorporated herein by reference, can be used as effective hole blocking layer material because its cyclic stability is extended. Silanes that can be used for making the hole-blocking layer of the photoreceptor include hydrolyzable silanes, such as 3-aminopropyltriethoxysilane, N-amino ethyl-3-aminopropyltrimethoxy-silane, N-2-aminoethyl-3-aminopropyltrimethoxy silane, N-2-aminoethyl-3-aminopropyltris(ethylethoxy) silane, p-aminophenyl trimethoxysilane, 3-amino propyldiethylmethylsilane, (N,N'-dimethyl 3-amino)-propyltriethoxy-silane, 3-aminopropyl methyldiethoxysilane, 3-aminopropyl trimethoxy-silane, N-methylamino-propyltriethoxysilane, methyl[2-(3-trimethoxysilylpropylamino)-ethylamino]-3-proprionate, (N,N'-dimethyl 3-amino) propyl triethoxysilane, N,N-dimethylaminophenyltriethoxysilane, trimethoxysilylpropyl diethylenetriamine and mixtures thereof. Good hole-blocking properties may be achieved when the reaction product of a hydrolyzed silane and metal oxide layer forms a blocking layer having a thickness of from about 0.002 μm to about 20 μm.

Also disclosed herein is an image forming apparatus for forming images on a recording medium comprising a photoreceptor member having a charge retentive surface to receive an electrostatic latent image thereon, wherein said photoreceptor member comprises a metal or metallized substrate having a passivation layer prepared using a sol-gel process, wherein the passivation layer comprises a rare earth metal, a charge generating layer, and a charge transport layer comprising charge transport materials dispersed therein; a development component to apply a developer material to said charge-retentive surface to develop said electrostatic latent image to form a developed image on said charge-retentive surface; a transfer component for transferring said developed image from said charge-retentive surface to another member or a copy substrate; and a fusing member to fuse said developed image to said copy substrate.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Example I

A sol-gel coating solution was prepared by dissolving 1.0 gram of cerium (IV) isopropoxide (80% isopropanol/Gelest, Inc.) and 0.5 gram of acetyl acetone (Sigma-Aldrich) in 50 grams of isopropanol. The mixture was heating to 80° C. for 2 hours and then cooled to room temperature. 0.3 gram of a nitric acid aqueous solution (0.1 weight %) was added and mixed overnight. The mixture was refluxed at 80° C. for 2 hours, cooled to room temperature, and then filtered through a 20-micrometer cloth filter. The dark brown solution was then ready to coat.

Example II

A photoreceptor device was prepared with the coating solution of Example 1. An aluminum substrate was coated with the sol-gel coating solution of Example I by ring coating. The coated substrate was cured at 125° C. for 40 minutes, and the passivation layer was about 0.2 μm. A charge generating layer comprising hydroxygallium phthalocyanine (V) was disposed on the cerium oxide passivation layer at a thickness of about 0.2 μm. The charge generating layer coating dispersion as prepared as follows: 3 grams of hydroxygallium phthalocyanine (HOGaPc) Type V pigment was mixed with 2 grams of polymeric binder (carboxyl-modified vinyl copolymer, VMCH, Dow Chemical Company), and 45 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 6 weight percent. Subsequently, a 23 μm charge transport layer was coated on top of the charge generating layer from a dispersion prepared from N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, Mw=40,000)] available from Mitsubishi Gas Chemical Company, Ltd. (7.13 grams), and PTFE POLYFLON™ L-2 microparticle (1 gram) available from Daikin Industries dissolved/dispersed in a solvent mixture of 20 grams of tetrahydrofuran (THF) and 6.7 grams of toluene via a CAVIPRO™ 300 nanomizer (Five Star Technology, Cleveland, Ohio). The charge transport layer was dried at about 120° C. for about 40 minutes. The device did not include an undercoat layer.

Comparative Example III

An untreated aluminum substrate was used for comparison purposes with the treated substrate of Example 1. A device was prepared by coating the untreated aluminum substrate as described in Example II. The untreated device did not include an undercoat layer.

The above prepared photoreceptor devices were tested in a scanner set to obtain photo induced discharge curves, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

Very similar photo-induced discharge curves (PIDC) were observed for the above two photoreceptor devices; thus an extra passivation layer in the photoreceptor does not adversely affect PIDC.

The devices of Example II and Comparative Example III were then acclimated for 24 hours before testing in A zone (85° F./80% Relative Humidity), and subsequently in J zone (70° F./10% Relative Humidity). Print tests were performed with an Imari Work Centre using black and white copy mode to achieve a machine speed of 52 mm/s. Background levels were measured against an empirical scale, where the smaller the background level, the better the print quality. Background metrics are summarized in Table 1.

TABLE 1

| Example | A Zone Background | J Zone Background |
|---|---|---|
| Comparative Example III | 7 | 7 |
| Example II | 1 | 1 |

The extra cerium oxide passivation layer significantly reduces print background in both zones.

Example IV

A photoreceptor device was prepared with the coating solution of Example 1. An aluminum substrate was coated with the sol-gel coating solution of Example I by ring coating. The coated substrate was cured at 160° C. for 40 minutes, and the passivation layer was about 0.2 μm. An undercoat layer dispersion was then coated on the passivated aluminum substrate and subsequently dried at 160° C. for 40 minutes, which resulted in an undercoat layer comprised of $TiO_2$/VARCUM™/CYMEL™ with a weight ratio of about 60/16/24 and a thickness of about 15 micrometers. The undercoat layer dispersion was prepared as follows: a titanium oxide/phenolic resin/melamine resin dispersion was prepared by ball milling 15 grams of titanium dioxide (MT-150W, Tayca Company), 8 grams of the phenolic resin (VARCUM™ 29159, OxyChem Company, $M_w$ of about 3,600, viscosity of about 200 cps) and 7.5 grams of the melamine resin (CYMEL™ 323, Cytec Industries) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with a HORIBA CAPA™ 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™/CYMEL™ dispersion. 0.5 grams of methyl ethyl ketone were added into the dispersion to obtain the coating dispersion. A chlorogallium phthalocyanine (ClGaPc) charge generating layer dispersion was prepared as follows: 2.7 grams of ClGaPc Type B pigment was mixed with about 2.3 grams of polymeric binder (carboxyl-modified vinyl copolymer, VMCH, Dow Chemical Company) and 45 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 5 weight percent with n-butyl acetate. The ClGaPc charge generating layer dispersion was applied on top of the above undercoat layer. The thickness of the charge generating layer was approximately 0.2 μm. Subsequently, a 16 μm charge transport layer was coated on top of the photogeneration layer from a dispersion prepared from N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, Mw=40,000)] available from Mitsubishi Gas Chemical Company, Ltd. (7.13 grams), and PTFE POLYFLON™ L-2 microparticle (1 gram) available from Daikin Industries dissolved/dispersed in a solvent mixture of 20 grams of tetrahydrofuran (THF) and 6.7 grams of toluene via CAVIPRO™ 300 nanomizer (Five Star Technology, Cleveland, Ohio). The charge transport layer was dried at about 120° C. for about 40 minutes.

Comparative Example V

An untreated aluminum substrate was used for comparison purposes. A device was prepared by coating the untreated aluminum substrate as described in Example IV.

Very similar photo-induced discharge curves (PIDC) were observed for the above two photoreceptor devices; thus an extra passivation layer in the photoreceptor does not adversely affect PIDC.

The devices of Example IV and Comparative Example V were then acclimated for 24 hours before testing in A zone (85° F./80% Relative Humidity). Print tests were performed using an Imari Work Centre using black and white copy mode to achieve machine speeds of 52, 104 and 194 mm/s. Background levels were measured against an empirical scale, where the smaller the background level, the better the print quality. Background metrics are summarized in Table 2.

TABLE 2

| | A Zone Background | | |
|---|---|---|---|
| Example | 52 mm/s | 104 mm/s | 194 mm/s |
| Comparative Example V | 4 | 2.5 | 1.5 |
| Example IV | 3 | 1.5 | 1 |

The extra cerium oxide passivation layer significantly reduces print background in A zone.

Example VI

A sol-gel coating solution was prepared as follows: 50 milliliters of zirconium isopropoxide (Sigma-Aldrich) and 12 milliliters of cerium isopropoxide (Sigma-Aldrich) were dissolved in 500 milliliters of isopropanol. 5 milliliters of acetylacetone was added drop wise as a chelating agent. The mixture was continuously stirred for 8 hours. Afterwards, about 3 milliliters of water was added during stirring to complete the hydrolysis and a small amount of $HNO_3$ was introduced as a catalyst. The mixture was then refluxed at 80° C. for 2 hours. After cooling down to room temperature, the solution was filtered in order to remove any particulates formed during the previous process steps.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for treating a metal substrate or a metallized substrate of an imaging member comprising:

providing a metal or metallized substrate of an imaging member;

treating the metal or metallized substrate with a sol-gel composition comprising a rare earth metal to form a passivation layer on the metal or metallized substrate using a sol-gel process wherein treating comprises applying a sol-gel solution consisting of a chelating agent and a rare earth metal alkoxide in a solvent to the substrate, drying so that hydrolysis, condensation and drying are accomplished on the substrate, to provide a rare earth metal oxide passivation layer; and disposing an undercoat layer on the passivation layer.

2. The method of claim 1, wherein the rare earth metal is selected from the group consisting of yttrium, lanthanum, neodymium, praseodymium, cerium, and combinations thereof.

3. The method of claim 1, wherein the rare earth metal is cerium.

4. The method of claim 1, wherein the rare earth metal is cerium and the cerium originates from an organic cerium compound.

5. The method of claim 1, wherein the rare earth metal is cerium, and the cerium originates from a member selected from the group consisting of cerium (IV) t-butoxide, cerium (IV) isopropoxide, cerium (IV) ethylthioethoxide, and cerium (IV) methoxyethoxide.

6. The method of claim 1, wherein the metal substrate comprises an aluminum substrate.

7. The method of claim 1, wherein the metal or metallized substrate contains an oxide layer and the oxide layer is treated with the sol-gel composition comprising a rare-earth metal.

8. The method of claim 1, wherein the sol-gel process comprises curing the sol-gel composition on the metal or metallized substrate at a temperature of from about 40° C. to about 300° C.

9. The method of claim 1, wherein the sol-gel process comprises curing the sol-gel composition on the metal or metallized substrate at a temperature of from about 80° C. to about 200° C.

10. The method of claim 1, wherein the undercoat layer consists of titanium dioxide.

* * * * *